United States Patent [19]

Dorius et al.

[11] 4,098,616

[45] Jul. 4, 1978

[54] RECIRCULATING DISHWASHER HOOD

[75] Inventors: John Dorius, Glendale; Daniel Moriarty, Burbank, both of Calif.

[73] Assignee: Elsters, Inc., Hollywood, Calif.

[21] Appl. No.: 774,769

[22] Filed: Mar. 7, 1977

[51] Int. Cl.[2] ..... B08B 7/00; B67C 1/100

[52] U.S. Cl. ..... 134/25 A; 98/115 R

[58] Field of Search ..... 134/25 A; 34/32, 34, 34/77, 78; 98/115 R

[56] References Cited

U.S. PATENT DOCUMENTS

| | | | |
|---|---|---|---|
| 3,728,866 | 4/1973 | Layton | 62/126 |
| 3,745,908 | 7/1973 | Mayberry | 98/115 |
| 3,811,250 | 5/1974 | Fowler | 55/274 |

*Primary Examiner*—S. Leon Bashore
*Assistant Examiner*—Chris Konkol
*Attorney, Agent, or Firm*—Spensley, Horn & Lubitz

[57] ABSTRACT

A recirculating exhaust hood for a dishwasher may be comprised of an exhaust duct, a positive pressure plenum, a negative pressure plenum, and a fan for circulating air from the communicating dishwashing cavity through the positive and negative pressure plenums, and the exhaust duct. Air drawn through the intake of the fan is circulated through the positive pressure plenum to a supply slot. High velocity air exiting from the supply slot to a contiguous intake port of the negative pressure plenum creates a high velocity stream of air which by entrainment or by Venturi effect draws warm moisture laden air from the dishwashing cavity into the negative pressure plenum. The entrained moist warm air is then recirculated to the positive pressure plenum by means of the fan. A portion of the output of the fan is directed to an exhaust duct and removed from the dishwashing system. One or more static pressure plates, drying coils, or heat exchanging coils may be appropriately disposed in the positive pressure plenum in order to couple energy from the warm moist air being circulated through the dishwashing cavity to a working fluid, to dry the air or to create the desired pressure differential.

6 Claims, 3 Drawing Figures

RECIRCULATING DISHWASHER HOOD

BACKGROUND OF THE INVENTION

1. Field of the Invention

The present invention relates to the field of ventilation and air treatment and conditioning equipment and in particular relates to the field of commercial dishwashing equipment.

2. Description of the Prior Art

Some dishwashing apparatus use one form or another of air drying to dry dishes within the apparatus during the appropriate drying cycle. It has long been appreciated that the air drying of dishes in a commercial dishwasher can be accelerated by increasing the temperature of air or water within the drying chamber. If dishes are continuously conveyed into the cavity on a conveyor-belt type dishwasher, some means is necessary to inhibit or prevent the escape of steam and vapors into the surrounding work spaces. It has long been appreciated that in addition to increasing temperatures in order to evaporate water from the dishes and to lower the relative humidity of the air, moisture laden air might later be cooled in order to induce condensation and to effectively dry the air for reuse during the drying cycle. One of the ways in which the prior art has sought to circulate and dry moisture laden air within a dishwashing chamber is shown in Karig, U.S. Letters Pat. No. 2,918,068.

Prior art dishwashing apparatus have employed comparatively inefficient means for isolating the dishwasher from surrounding work spaces and for drying the moisture laden air within the dishwasher cavity. The prior art has generally failed to address or deal with problems concerning air circulation through dishwashing cavity, or energy efficiency during the dishwashing operation. Typically, such dishwashers create an air flow through the cavity by drawing in large amounts of fresh make-up air in order to obtain the desired flow rate, preheating it, using it during the dishwasher operations and then exhausting substantially all of it to the outside environment. As a consequence, large amounts of treated air are drawn from the work space and lost to the outside environment. As disclosed below, the present invention has overcome each of these problems and inadequacies of the prior art.

BRIEF SUMMARY OF THE INVENTION

A recirculating exhaust hood for a dishwashing apparatus may be comprised of an exhaust duct, a first plenum, a second plenum, and a means for recirculating air. The first plenum communicates with the dishwashing apparatus through an inlet port. The first plenum may be a negative pressure plenum for moving air from the dishwashing apparatus. The second plenum also communicates with the dishwashing apparatus through an outlet port. The second plenum is used for delivering air to the dishwashing apparatus. Means for recirculating air from the dishwashing apparatus through the first and second plenum, then back to the dishwashing apparatus is coupled to the first and second plenums and the exhaust duct. A portion of the air drawn by this means from the first plenum is exhausted to the external environment through the exhaust duct. Therefore, a high volume and velocity air flow may be obtained without exhausting large amounts of treated air to the environment.

The recirculating exhaust hood may further include a static pressure plate disposed in the second plenum in order to increase air velocity and evenly distribute the air flow within a selected portion of the second plenum. Means for drying recirculated air as it circulates through the second plenum may also be disposed in the second plenum according to the present invention. In addition, the recirculating exhaust hood may further include an energy exchanging means disposed in the second plenum for transferring thermal energy from the air being recirculated through the dishwashing apparatus to a working fluid flowing within the energy exchanging means.

The recirculating exhaust hood operates as follows in connection with a dishwashing apparatus. Moist air is entrained in the upper portion of the dishwashing apparatus in a high velocity air flow. The entrained moist air is drawn into a first plenum by means of a rotorary impeller fan. A fraction of the air drawn from the first plenum is expelled into a second plenum by means of a rotorary impeller fan and the remaining fraction of the air from the first plenum is expelled into an exhaust duct. The high velocity air flow between the first and second plenum is formed by means of air exiting from an outlet port in the second plenum, and entering an inlet port in the first plenum. The fresh makeup air is drawn from the environment through the dishwashing apparatus in order to replace that fraction of the air expelled through the exhaust duct. The recirculating exhaust hood may include an assembly of cooling coils disposed in the second plenum between the rotorary impeller fan and the outlet port of the second plenum to transfer heat from the air in the second plenum to a working fluid. The air in the second plenum is dried by the condensation of water vapor from the air by means of the cooling coils. The pressure gradient in the second plenum between the rotorary impeller fan and the outlet port of the second plenum may be increased by means of a static pressure plate, which in some applications may be the assembly of cooling coils.

DETAILED DESCRIPTION OF THE PREFERRED EMBODIMENTS

The present invention is a recirculating exhaust hood which is particularly adapted for commercial diswashers. The hood is capable of achieving high circulation rates without necessitating large amounts of make-up air or providing means to pre-heat or pre-cool large amounts of make-up air. The exhaust hood is comprised of a first or negative pressure plenum, and a second or positive pressure plenum together with an exhaust duct and means for recirculating air within the plenums and duct. By means of the air recirculation pattern created in a dishwashing apparatus by the present invention, the efficiency of the air circulation pattern during all modes of washing may be substantially improved without sacrificing the energy efficiency of the operation of the exhaust hood. Among the advantageous features of the present invention is the utilization of a high velocity air flow between the second plenum and the first plenum to create a Venturi effect and to efficiently entrain moisture laden air within the dishwasher cavity into the recirculating air pattern of the exhaust hood. By exhausting only a fraction of the recirculated air, as disclosed below, the amount of energy lost in the exhausted air and absorbed by the fresh makeup air is minimized without jeopardizing isolation of the cavity by decreasing the volume and velocity of air flow at the egress and ingress to the cavity of the dishwasher. Furthermore, one or more heat exchanging means may be disposed in the second plenum to act as static pressure plates and to provide a means for drying the air and transferring the absorbed energy to a working fluid, which is typically the water which will later be used in the dishwashing operation. Each of these aspects and the various embodiments of the present invention are better understood in connection with the description of FIGS. 1 – 3.

Figure 1:
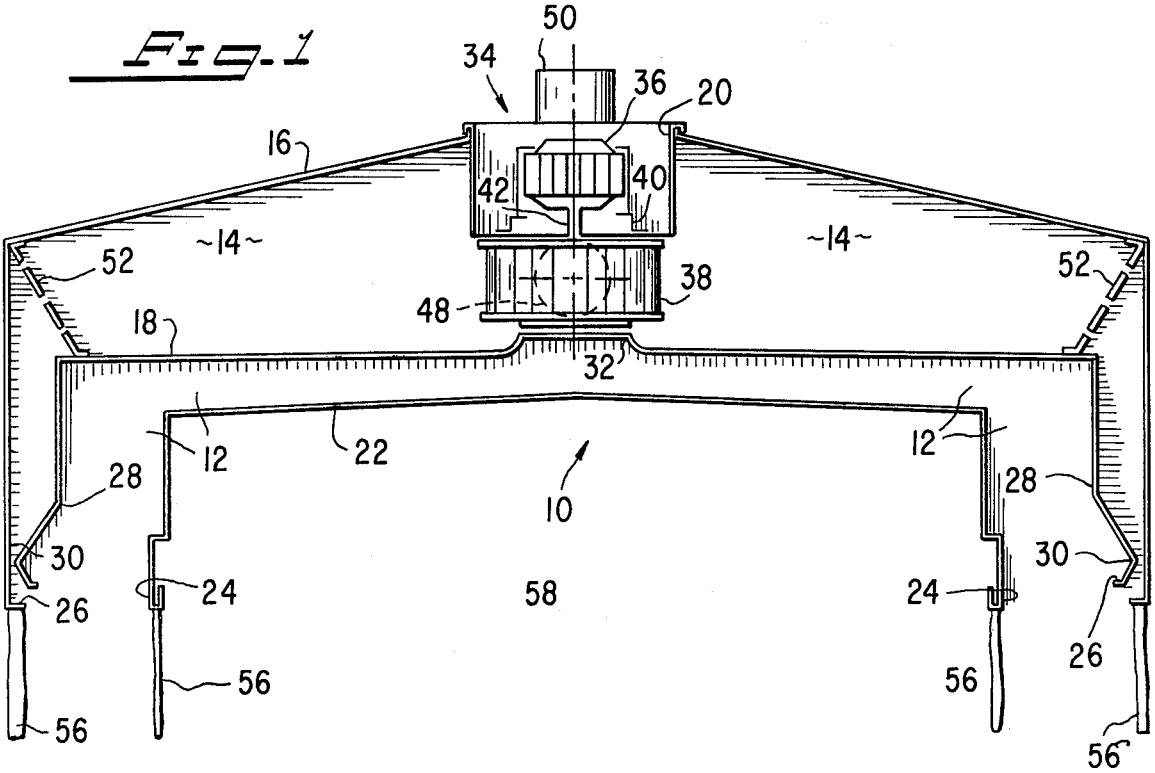
FIG. 1 is a cross sectional view of a recirculating exhaust hood fabricated according to the present invention.

The recirculating exhaust hood 10 and its major structural features are shown in the cross sectional view in FIG. 1. Recirculating exhaust hood 10 is comprised of a first or negative pressure plenum 12 and a second or positive pressure plenum 14. As illustrated in FIG. 1, plenum 14 may be formed by means of an outer wall 16 and a common innerwall 18. Outer wall 16 also serves the function of forming the outer surface of recirculating exhaust hood 10. A selected portion, such as the central upper portion of outer wall 16 may be modified to form a motor well 20. Plenum 12 is similarly comprised of an internal wall 22 and common inner wall 18. Internal wall 22 also doubles as the internal wall of recirculating exhaust hood 10 and forms the upper portion of the internal cavity of the dishwashing apparatus. The particular form and shape of wall 16, 18, and 22 are shown in FIG. 1 only by way of example and are not intended to limit the scope of the present invention. It is to be expressly understood that any configuration for first plenum 12 and second plenum 14, well known to the art, may be used.

In the particular embodiment illustrated, first plenum 12 is shown as having an inlet port 24 which is contiguous or juxtaposed to an outlet port 26 of second plenum 14. It should be noted that common inner wall 18 has a bend 28 which restricts the cross-sectional area of plenum 14 to a narrow orifice 30. Orifice 30 enhances the velocity of air flow and acts as a nozzle. Common inner wall 18 then bends outwardly forming a flared end portion of plenum 14 which terminates in outlet port 26 and serves as a supply slot. A high velocity stream of air is then directed across inlet port 24 of plenum 12 and is drawn upward into the negative pressure plenum.

Figure 2:
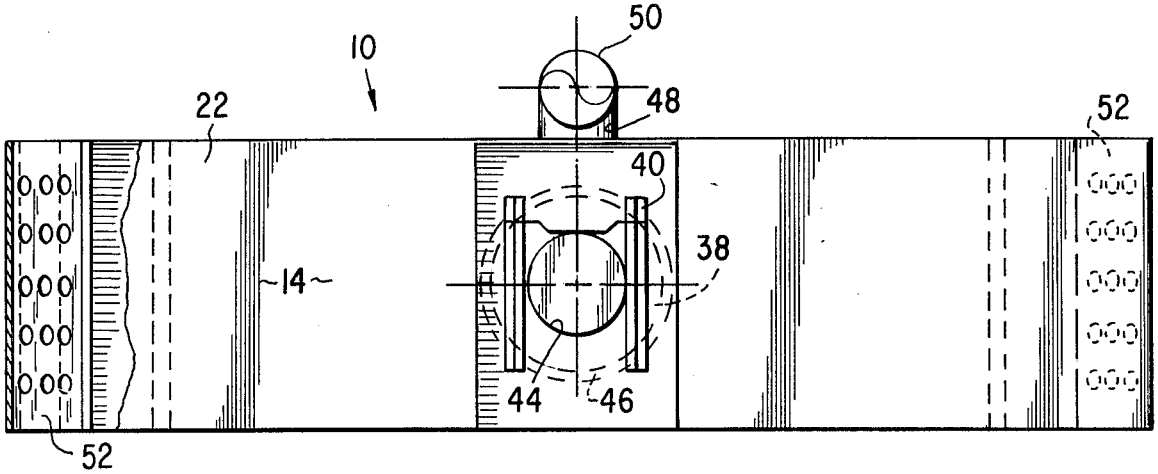
FIG. 2 is a plan view of the recirculating exhaust hood shown in FIG. 1.

Means for recirculating the air drawn from the dishwashing apparatus is generally denoted by the reference character 34. In the embodiment illustrated in FIG. 1 means 34 includes an electric motor 36 and a rotorary fan or impeller 38. Typically impeller 38 may be a squirrel cage fan or any other similar type well known to the art. Electric motor 36 is mounted within motor well 20 on a suitable motor bracket 40 and is coupled to impeller 38 by a drive shaft 42. Impeller 38 is disposed close enough to outlet port 32 of plenum 12 to form an effective seal between impeller 38 and common inner wall 18. It is to be understood that any other means or configuration known to the art may be used to effect the desired seal between impeller 38 and inner wall 18. In the present embodiment, even though there may be an appreciable clearance between impeller 38 and port 32, no substantial reverse leakage of air is possible since the momentum vector of air flow is well defined and stable due to the energy imparted to the air by impeller 38. Thus, the only passage through which any substantial amount of air may flow from plenum 12 to plenum 14 is through port 32 and impeller 38. Impeller 38 is arranged and configured so as to draw air from its internal periphery 44 and forcefully expel the entrained air around its entire external periphery 46 (FIG. 2). As shown in FIG. 1, an inlet port 48 is disposed behind impeller 38 and is coupled to an exhaust duct 50, which is more easily seen in FIG. 2. Thus, air drawn by impeller 38 through port 32 is forcefully expelled along the entire circumferential periphery of impeller 38. A portion of the expelled air, in that sector of the periphery of impeller 38 circumscribed by the inlet port 48, is directed into exhaust duct 50 and ultimately returned to the environment. The remaining portion of air expelled from the periphery of impeller 38 flows to both sides of plenum 14 and is recirculated to inlet port 24 of plenum 12.

The plan view of FIG. 2 illustrates the relationship between impeller 38 and exhaust duct 50 in greater detail. It is to be understood that the manner in which means 34 is coupled to exhaust duct 50 and plenums 12 and 14 are shown in FIGS. 1 and 2 by way of example only, and that any means well known to the art may be employed to distribute preselected portions of the output air of means 34 to exhaust duct 50 or plenum 14. In the illustrated embodiment the preselected fractions distributed between exhaust duct 50 and plenum 14 may be altered by varying the closeness of inlet port 48 to the external periphery 46 of impeller 38 or by varying the size of inlet port 48, each of which alterations serve to modify the effective sector of impeller 38 circumscribed by inlet port 48.

Figure 3:
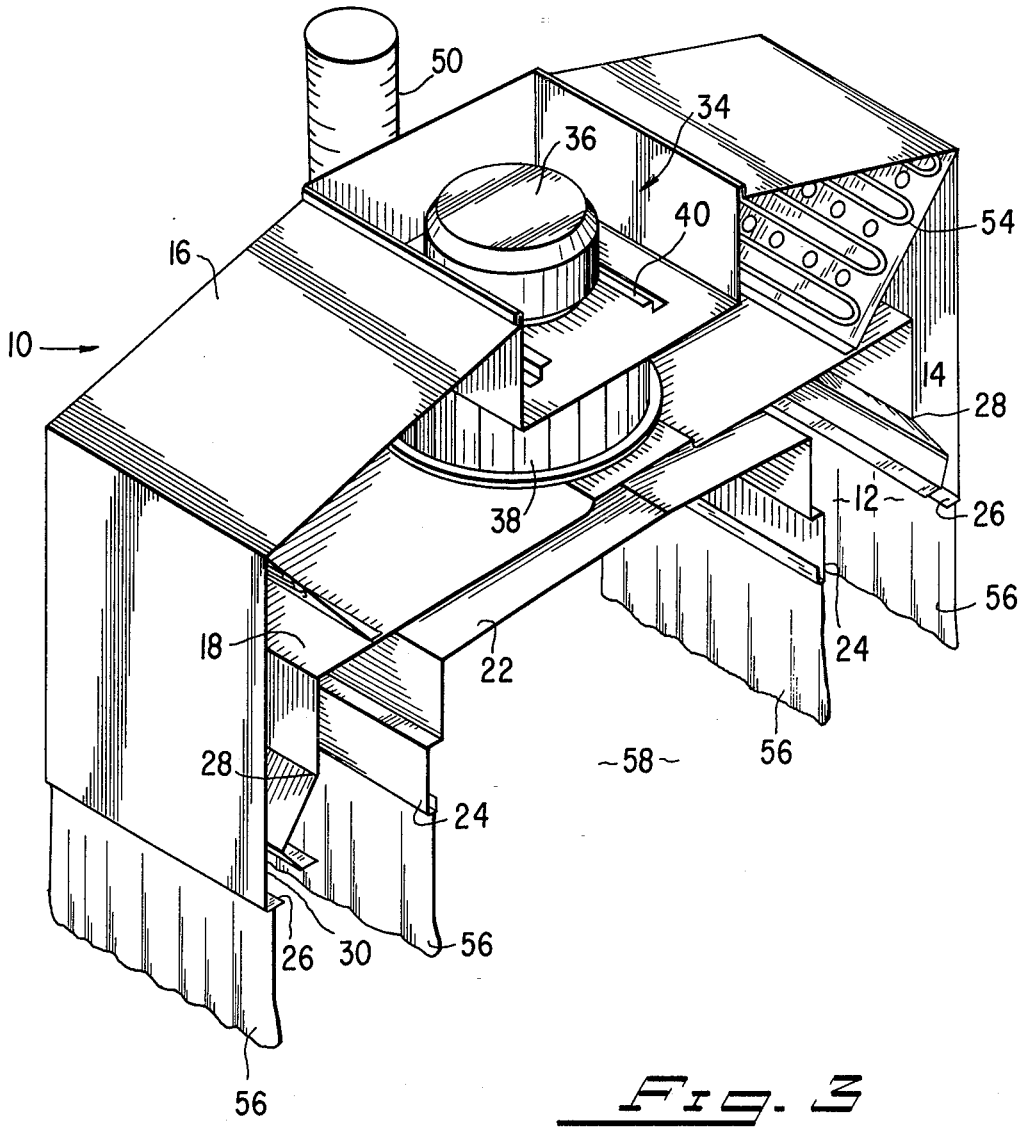
FIG. 3 is a perspective view of one embodiment of the present invention with the front wall of the exhaust hood removed.

It may also be generally desirable to dispose a static pressure plate 52 on each side of plenum 14 in order to obtain proper pressure distribution and air velocities across the cross sectional area of plenum 14. Typically, static pressure plate 52 may be a perforated barrier, such as a sheet metal plate which has been fixed across the entire cross sectional area of plenum 14. The degree of perforation is variable and may be chosen according to design to obtain the desired flow rates within the plenums. In one embodiment, static pressure plate 52 is 50% open. Static pressure plate 52 may be comprised of an assembly of cooling coils, well known to the art, through which a working fluid is circulated. FIG. 3 illustrates one embodiment of the present invention where the perforated plates of FIG. 1 have been replaced by such coils. Warm moist air flowing though coils 54 is cooled and a substantial fraction of the air carried moisture is condensed. The condensed moisture is returned by gravity flow to the dishwasher cavity, and the now dried air is recirculated from plenum 14 through plenum 12 as described. The cooling water flowing through coils 54 may also be the working fluid for the dishwashing apparatus to which recirculating exhaust hood 10 is coupled. In that case, the energy extracted from the warm moist air recirculating through the dishwasher cavity is added to water to be subsequently used in the cavity, thereby increasing the water temperature and the efficiency of the overall dishwashing system.

The operation of the present invention may be appreciated by viewing the embodiment of FIG. 3. Assume, for example, that the ambient room temperature is 75°

F., the wash water temperature is 180° F., and there is approximately 20% radiation and heat losses from the hood. Impeller 38 may be driven by motor 36 and may be capable of delivering approximately 1000 cubic feet per minute. In this embodiment of the present invention, 450 cubic feet per minute is applied to each side of plenum 14 while approximately 100 cubic feet per minute enters exhaust duct 50. The warm moisture laden air is forced by impeller 38 through plenum 14 to coils 54 where it is cooled and dried. Approximately 50% of the area of the coil is open. Air on the downstream side of coils 54 has an exit velocity of approximately 450 feet per minute at a capacity of 450 cubic feet per minute. The dried air travels downward through plenum 14 and increases in velocity to approximately 675 feet per minute at a point just below bend 28 as plenum 14 narrows. At orifice 30 the air velocity increases dramatically to approximately 4320 feet per minute and exits from outlet port 26 with a velocity of approximately 2160 feet per minute at about 130° F. A high velocity air stream forms across inlet port 24 of plenum 12 and entrains about 50 cubic feet per minute of fresh makeup air on each side through isolation curtains 56. Substantially all excess steam and airborne water droplets generated within cavity 58 are drawn up into the air curtains formed by the Venturi effect across inlet port 24. Isolation curtains 56 are typically flexible lengths of fabric or synthetic material which are used to isolate the environment within the dishwasher cavity 58 from the ambient without interfering with the movement of dishes and other items being washed through cavity 58. Recirculating exhaust hood 10 shown in FIG. 3 is typically used in conveyor belt type dishwashing apparatus. The soiled dishes are loaded at one end and moved through the various washing and drying operations provided within cavity 58 to the opposing end. Thus, isolation curtains 56 may be necessary to provide a partial barrier between the splashing water and steamy environment within cavity 58 and the external environment surrounding the dishwasher. Approximately 500 cubic feet per minute is drawn in each side of plenum 12 with an air velocity of approximately 330 feet per minute. The air temperature within plenum 12 at this point has risen to approximately 137° F. Thus, approximately 1000 cubic feet per minute is delivered to port 32 of impeller 38 to be recirculated and a portion to be selectively exhausted as described above. Thus, a high velocity air flow, which efficiently entrains warm moist air by a Venturi effect formed across inlet port 24 of plenum 12, is accomplished without the need for introducing and heating large amounts of fresh make-up air. It is to be understood, however, that the above illustration of temperatures, air flow rates, and air velocities are for illustrative purposes only and are not to be taken as limiting the scope of the present invention. The values of each parameter can change according to the details and modifications of each application. For example, the amount of fresh make-up air drawn into the exhaust hood will vary depending on the diameter of the exhaust duct, its length of run and the design of the cap chosen at its termination.

We claim:

1. A recirculating exhaust hood for use with a dishwashing apparatus comprising:

an exhaust duct;

a first plenum communicating with said dishwashing apparatus through an inlet port, said first plenum for removing air from said dishwashing apparatus;

a second plenum communicating with said dishwashing apparatus through an outlet port, said plenum for delivering air to said dishwashing apparatus; and means for recirculating air from said dishwashing apparatus, through said first plenum to said second plenum and back to said dishwashing apparatus, a portion of air drawn from said first plenum being exhausted to the external environmental through said exhaust duct by said means for recirculating air, said means coupled to said first and second plenum and said exhaust duct wherein the means for recirculating air is a rotary fan assembly having an inlet coupled to said first plenum, a first outlet coupled to said second plenum and a second outlet coupled to said exhaust duct, said rotary fan assembly having an internal intake region coupled to said first plenum and having a first sector of its output periphery circumscribed by said second plenum and a second sector of its output periphery circumscribed by said exhaust duct, and wherein said rotary fan assembly is disposed within said second plenum, said second plenum providing a housing for said rotary fan assembly, and a sector of the output periphery of said rotary fan assembly is juxtapositioned next to the inlet port of said exhaust duct.

2. The recirculating exhaust hood of claim 1 further comprising a pressure plate wherein said pressure plate is an assembly of cooling coils disposed in said second plenum between said means for recirculating air and said outlet port of said second plenum, said assembly of cooling coils increasing the velocity of air within a selected portion of said second plenum, drying air being circulated therethrough, and transferring thermal energy from circulated air to a working fluid flowing through said cooling coils.

3. A recirculating exhaust hood for use with a dishwashing apparatus comprising:

an exhaust duct;

a first plenum communicating with said dishwashing apparatus through an inlet port, said first plenum for removing air from said dishwashing apparatus;

a second plenum communicating with said dishwashing apparatus through an outlet port, said second plenum for delivering air to said dishwashing apparatus, a high velocity stream of air being formed between said outlet port of said second plenum and said inlet port of said first plenum to entrain air within said dishwashing apparatus;

a fan for recirculating a first portion of air from said first plenum to said second plenum and a second portion of air from said first plenum to said exhaust duct; and a pressure plate comprised of an assembly of cooling coils disposed in said second plenum between said fan and outlet port of said second plenum, said cooing coils containing a working fluid to absorb heat from air in said second plenum, wherein said fan is a rotary impeller fan having a central intake and peripheral output, said peripheral output being circumscribed by said second plenum and said exhaust duct, and wherein said rotary impeller fan is disposed in said second plenum and juxtaposed next to the inlet port of said exhaust duct.

4. The exhaust hood of claim 1 wherein said working fluid is water to be used within said dishwashing apparatus, and wherein said assembly of cooling coils increases the velocity of air exiting said outlet port of said second plenum, preheats the water used in said dishwashing apparatus, and condenses water vapor contained in air being recirculated through said second plenum.

5. A method of recirculating air for use in a dishwashing apparatus comprising the steps of:

entraining moist air in the upper portion of said dishwashing apparatus in a high velocity air flow;

drawing said entrained moist air into a first plenum by means of a rotary impeller fan;

expelling a fraction of said air from said first plenum into a second plenum by means of said rotary impeller fan and the remaining fraction of said air from said first plenum into an exhaust duct;

forming said high velocity air flow between said second and first plenum by means of said air exiting from an outlet port in said second plenum and said air entering an inlet port in said first plenum;

drawing fresh makeup air from the environment through said dishwashing apparatus transferring heat from said air in said second plenum by means of an assembly of cooling coils disposed in said second plenum between said rotary impeller fan and said outlet port of said second plenum, drying said air in said second plenum by condensing water vapor therefrom by said assembly of cooling coils; and increasing the pressure gradient in said second plenum by means of said assembly of cooling coils acting as a static pressure plate.

6. The method of claim 5 wherein said rotary impeller fan is disposed in said second plenum, said rotary impeller fan having a central intake region communicating with said first plenum and having a peripheral output region enclosed within said second plenum but for a fractional sector of said peripheral output being juxtaposed next to the inlet port of an exhaust duct.

* * * * *